US010731452B2

(12) United States Patent
Ellithorp

(10) Patent No.: US 10,731,452 B2
(45) Date of Patent: Aug. 4, 2020

(54) GAS SEPARATOR ASSEMBLY WITH DEGRADABLE MATERIAL

(71) Applicant: Blackjack Production Tools, LLC, Oklahoma City, OK (US)

(72) Inventor: Brian Ellithorp, Edmond, OK (US)

(73) Assignee: Blackjack Production Tools, LLC, Oklahoma City, OK (US)

( * ) Notice: Subject to any disclaimer, the term of this patent is extended or adjusted under 35 U.S.C. 154(b) by 245 days.

(21) Appl. No.: 15/998,674

(22) Filed: Aug. 16, 2018

(65) Prior Publication Data

US 2019/0055809 A1 Feb. 21, 2019

Related U.S. Application Data

(60) Provisional application No. 62/546,226, filed on Aug. 16, 2017.

(51) Int. Cl.

| | |
|---|---|
| ***E21B 43/38*** | (2006.01) |
| ***E21B 33/12*** | (2006.01) |
| ***E21B 33/13*** | (2006.01) |
| ***E21B 33/124*** | (2006.01) |
| ***E21B 43/12*** | (2006.01) |
| ***E21B 34/06*** | (2006.01) |
| ***E21B 29/00*** | (2006.01) |

(52) U.S. Cl.

CPC ..... *E21B 43/38* (2013.01); *E21B 29/00* (2013.01); *E21B 33/124* (2013.01); *E21B 33/1208* (2013.01); *E21B 33/13* (2013.01); *E21B 34/063* (2013.01); *E21B 43/128* (2013.01)

(58) Field of Classification Search

CPC ..... E21B 43/38; E21B 43/385; E21B 34/063; E21B 33/1208; E21B 33/13; E21B 29/00; E21B 29/02

USPC ..... 166/376

See application file for complete search history.

(56) References Cited

U.S. PATENT DOCUMENTS

| | | | |
|---|---|---|---|
| 2,883,940 | A | 4/1959 | Gibson |
| 3,894,583 | A | 7/1975 | Morgan |
| 4,676,308 | A | 6/1987 | Chow et al. |
| 4,981,175 | A | 1/1991 | Powers |
| 6,039,121 | A | 3/2000 | Kisman |
| 6,235,143 | B1 | 12/2001 | Scarsdale |
| 6,932,160 | B2 | 8/2005 | Murray et al. |

(Continued)

OTHER PUBLICATIONS

Korean Intellectual Property Office, "PCT International Search Report", dated Dec. 14, 2018, 3 pages.

*Primary Examiner* — Blake E Michener

(74) *Attorney, Agent, or Firm* — Tomlinson McKinstry, P.C.

(57) ABSTRACT

A gas separator assembly has a pump inlet that generates an artificial sump in a production casing. The assembly includes an inner casing in series with the production casing of the well and an outer casing supported externally of the inner casing. First and second ports at opposing top and bottom ends of the outer casing communicate from the production casing to an annulus between the inner and outer casings. A barrier supported in the primary passage between the first and second ports diverts flow through the annulus. One or more dissolvable sleeves within the annulus prevents the annulus from filling with material during construction of the casing but dissolves when the sleeves come in contact with wet wellbore fluid.

24 Claims, 2 Drawing Sheets

(56) References Cited

U.S. PATENT DOCUMENTS

| | | | | |
|---|---|---|---|---|
| 7,021,373 | B2 | 4/2006 | Hardgrave | |
| 7,055,595 | B2 | 6/2006 | Mack et al. | |
| 7,270,178 | B2 | 9/2007 | Selph | |
| 7,635,030 | B2 | 12/2009 | Knight et al. | |
| 7,736,133 | B2 | 6/2010 | Martinez | |
| 8,141,625 | B2 | 3/2012 | Reid | |
| 8,397,811 | B2 | 3/2013 | Reid | |
| 9,518,458 | B2 | 12/2016 | Ellithorp et al. | |
| 9,909,400 | B2 | 3/2018 | Ellithorp et al. | |
| 2009/0065202 | A1 | 3/2009 | Brown et al. | |
| 2010/0031992 | A1 | 12/2010 | Reid | |
| 2011/0214881 | A1* | 9/2011 | Newton | E21B 34/063 166/373 |
| 2013/0068455 | A1 | 3/2013 | Brown et al. | |
| 2014/0110133 | A1* | 4/2014 | Ellithorp | E21B 43/128 166/378 |
| 2014/0318780 | A1 | 10/2014 | Howard | |
| 2015/0330191 | A1 | 11/2015 | Holderman | |
| 2016/0333655 | A1 | 11/2016 | Fripp et al. | |
| 2016/0369592 | A1 | 12/2016 | Aitken et al. | |
| 2017/0058654 | A1 | 3/2017 | Ellithorp et al. | |
| 2018/0187531 | A1 | 7/2018 | Ellithorp et al. | |

* cited by examiner

GAS SEPARATOR ASSEMBLY WITH DEGRADABLE MATERIAL

FIELD

The present invention relates to a gas separator assembly with a degradable sleeve formed thereon.

BACKGROUND

When pumping from a hydrocarbon producing well containing gas and liquid it is known to be desirable to separate the gas from the liquid in order for the pump to operate effectively. Gas separators have various deficiencies such that gas interference, resultant gas-locking, and potential resultant damages to downhole pumping equipment, as well as downtime and deferred production is an ongoing problem.

Most horizontal wells are completed with 5.5 inch and sometimes 4.5 inch production casing strings in all current domestic gas and oil plays. This leaves roughly 4.00 to 4.75 inches to convey and operate any form of artificial lift and gas separator. There are numerous gas separation techniques used for each form of artificial lift, but most are moderately successful at best and some do a very poor job, but may be the only option.

The most effective form of separation in horizontal wells has come by way of a sump or an extended section off the primary production casing that is drilled post completion, often at a tangent in the curves build section typically at 30 to 60 degrees, allowing for fluids to fall to a pump set below and allowing gas to break and travel upward. This is a costly method of separation due to added drilling and completion costs and there are risks involved such as wellbore stability and integrity issues, possibility to have issues running tools into the lateral, etc.

Additional examples of gas separators are described in U.S. Pat. No. 6,932,160 by Murray et al, U.S. Pat. No. 7,055,595 by Mack et al, U.S. Pat. No. 4,676,308 by Chow et al, and U.S. Pat. No. 2,883,940 by Gibson et al, the contents of which are incorporated herein by reference. Known gas separator devices can typically have limited effectiveness while occupying large amounts of space within the interior diameter of the well casing such that insertion and removal from the well casing may be awkward and difficult, and/or limited access is provided for other downhole tools if desired.

SUMMARY

The invention is directed to an assembly. The assembly comprises a production tube string, a hollow inner member, an outer member supported outside the inner member, a barrier, a degradable sleeve, and a pump inlet. The production tube string is positioned within a wellbore. The inner member has opposed first and second ends and a hollow region extending end to end. The first and second ends are configured for connection to a well casing. The outer member defines an annular region extending longitudinally and externally of the inner member. A first port is formed between the annular passage and the hollow region. A second port is formed between the annular passage and the hollow region. The barrier is positioned within the hollow region between the first port and the second port. The sleeve is disposed in the annular space between the first port and the second port. The pump inlet is located within the hollow region between the first port and the barrier at a distal end of the production tubing.

DETAILED DESCRIPTION

Figure 1:
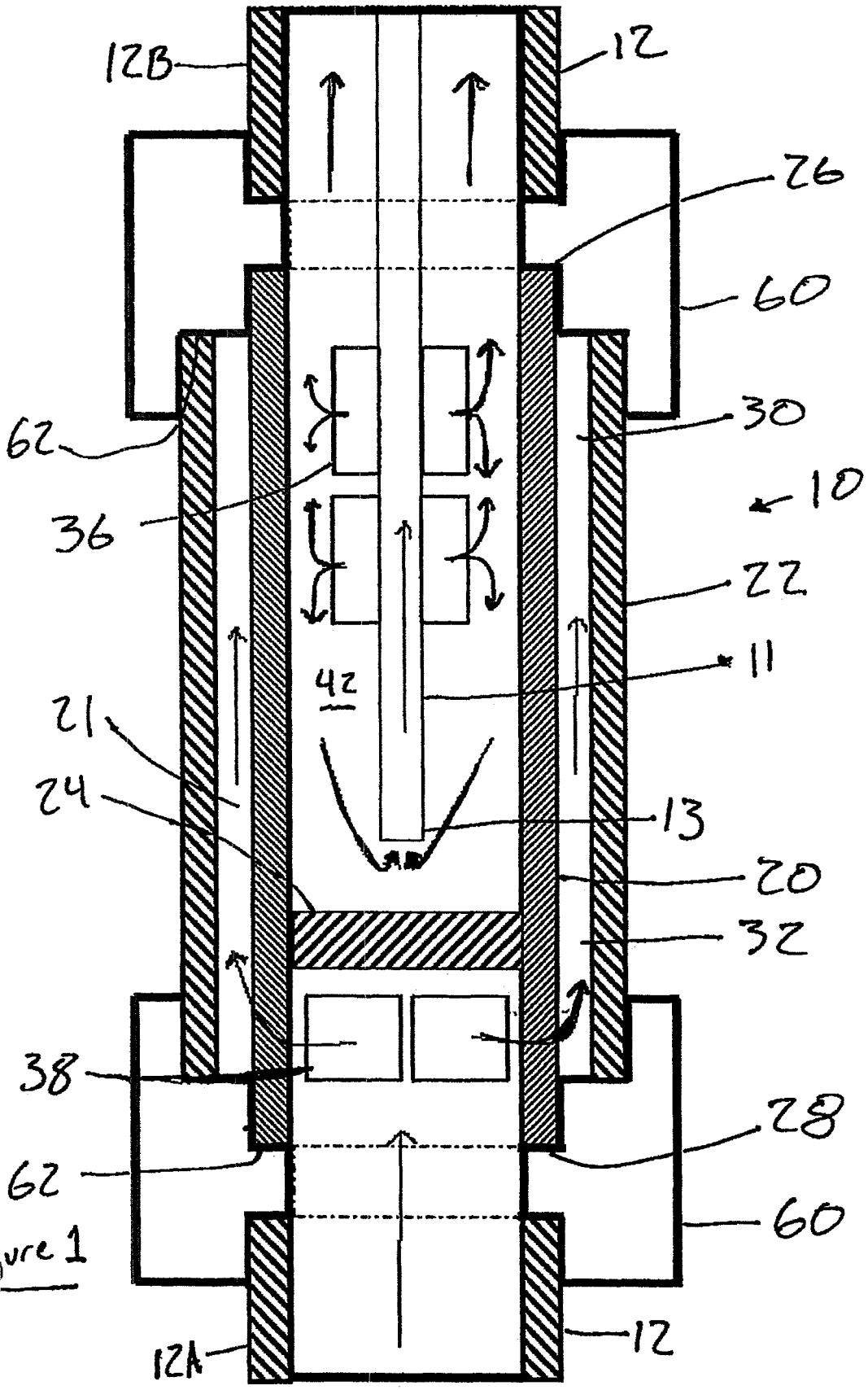
FIG. 1 is a sectional side elevational view of a gas separator assembly according to the present invention.

A gas separator assembly 10 is shown in FIG. 1. The assembly 10 is particularly suited for use with a downhole pump inlet 13 supported on the bottom end of a production tubing string 11 and arranged to be received within the longstring, or well casing 12 of a well containing liquid and gas. A pump is preferably connected to the tubing 11, but may not be within the gas separator 10. So long as the pump pulls fluid into the tubing 11 as shown in FIG. 1, the precise location of the pump is not limiting.

The assembly 10 generally includes an inner casing member 20, an outer casing member 22 concentrically receiving the inner casing extending longitudinally therethrough, and a barrier member 24. The barrier member 24 may be received within the inner casing member 20 to selectively seal the passage through the inner casing member as described in further detail below.

The inner casing member 20 is an elongate cylindrical tubular member which defines a primary passage extending longitudinally along the full length thereof between a top first end 26 and a bottom second end 28 of the assembly. The longitudinally opposed ends of the inner casing member 20 at the first 26 and second ends 28 of the overall assembly 10 may be connected in series with corresponding connections within the well casing 12. In one embodiment, shown in FIG. 1, inner casing member 20 is suitably sized such that the interior diameter of the primary passage extending therethrough is approximately equal to an interior diameter of the well casing 12. In another embodiment, the inner casing member may be sized to be smaller than the well casing 12, with the outer casing member 22 being approximately equal to the well casing 12.

The well casing 12 below the separator 10 will be designated as lower well casing 12A. The well casing between the separator and the surface will be designated upper well casing 12B. A coupler 60 may be utilized on each end 26, 28 of the assembly 10 to facilitate connection with the well casing 12. The coupler may seat with the well casing 12 and the inner casing member 20 at a shoulder 62, or other attachment means may be used.

As shown in FIG. 1, the outer casing member 22 is a cylindrical tubular member that surrounds the inner casing member 20 substantially along its full length. An annular space 21 is formed between the inner diameter of the outer casing member 22 and the outer diameter of the inner casing member 20.

A plurality of top ports, or first ports 36 communicate through the wall of the inner casing member 20 for communication between the annular space 21 and the inside of the inner casing member. The first ports 36, as shown, are rectangular openings. It should be understood that first ports 36 may be spaced apart both circumferentially and longitudinally on the inner member 36, and are located on a first side of the barrier 24. A first end 30 of the annular space 21 only communicates with the inside of the inner casing member 20 and attached upper well casing 12B through the first ports 36.

Figure 2:
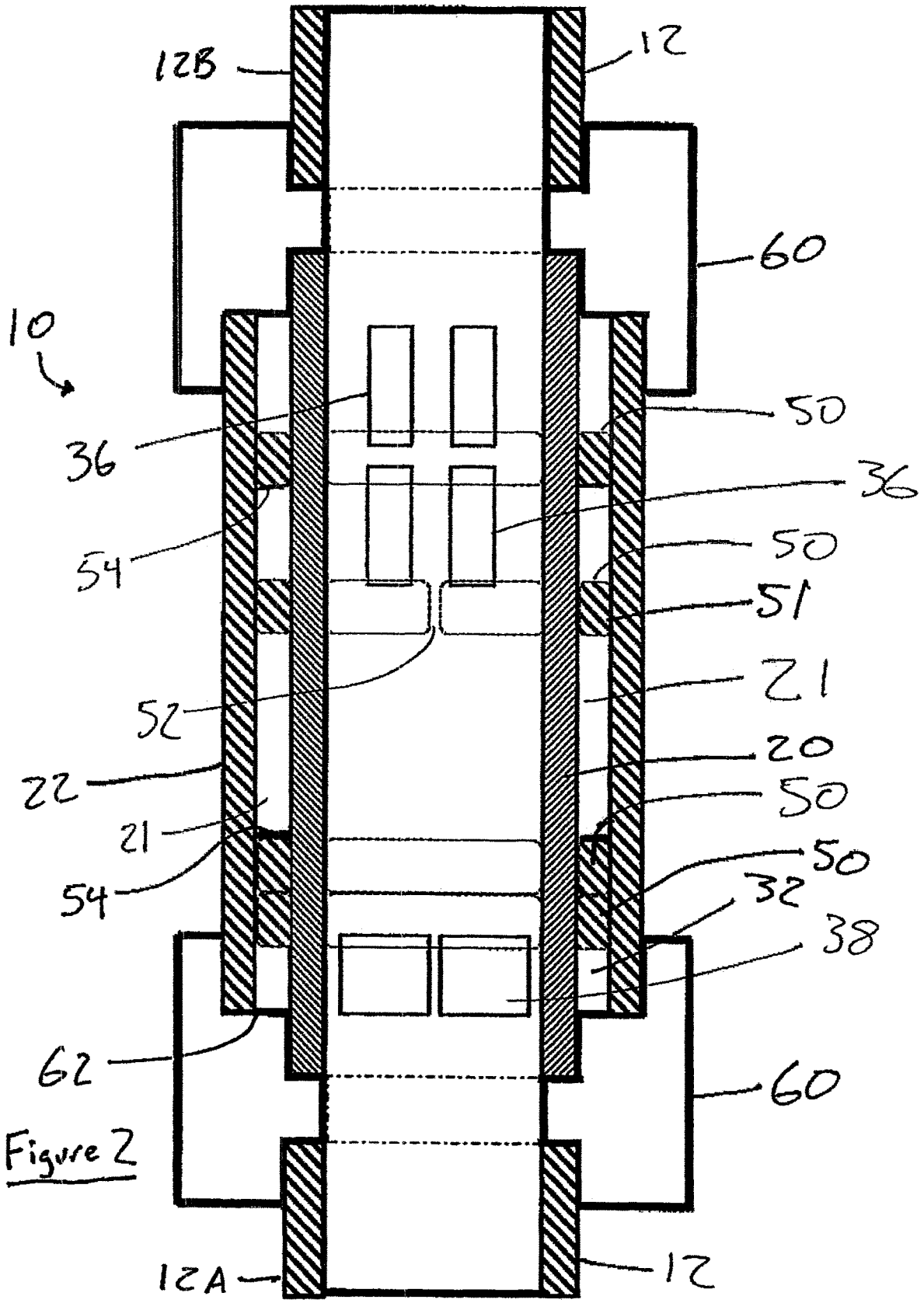
FIG. 2 is a sectional side view of the casing of a gas separator assembly such as that of FIG. 1, with a degradable sleeve located within the annular space.

Second ports 38 are similarly located in close proximity to a second end 32 of the annular space 21. The second ports 38 are openings located at a common longitudinal position at evenly spaced apart locations. In the embodiment of FIGS. 1-2, the second ports 38 are rectangular. The second end 32 of the annular space 21 only communicates with the downhole portion of the inner casing member 20 and attached lower well casing 12A through the second ports 38.

Larger ports 36, 38 may cause the annular space 21, rather than the size of ports 36, 38, to limit flow through the assembly 10.

As shown by arrows in FIG. 1, flow of fluid up through the lower well casing 12A from a production zone below the assembly 10 enters at the bottom of the assembly and can flow through the second ports 38. Balancing of pressure from the interior of the inner casing member 20 to the annular space 21 through the ports 38 limits any pressure deferential across the wall of the inner casing. Thus, the wall thickness of the inner casing member 20 can be thinner than the outer casing member 22.

The barrier member 24 is supported within the inner casing member 20. The barrier member 24 may be a conventional plug for forming a seal. The barrier member 24 is directly above the second ports 38 towards the bottom end of the assembly 10. The barrier member 24 defines an artificial sump area 42 within the inner casing member 20 which spans longitudinally from the barrier 24 to the first ports 36. The cross sectional area of the artificial sump area corresponds to the full interior diameter of the inner casing member 20. As shown, this corresponds approximately to the full interior diameter of the outer casing 12 of the well.

With reference to FIG. 2, the inner 20 and outer casing member 22 are shown before the tubing 11 and barrier 24 are placed. In FIG. 2, a series of degradable sleeves 50 are used within the annular space 21. The sleeves 50 may not shift within the annular space, and are machined to hold their position. Preferably, no gap exists between the sleeves 50 and the abutting walls of the casing members 20, 22. In this way, the sleeves 50 are not contacted by well fluids or other dissolving fluids, except along the top and bottom edges, or along a longitudinal slot 52 as described in more detail below.

The degradable sleeve or sleeves 50 is formed of a degradable material, such as a polymer or dissolvable metal. The sleeve 50 forms a temporary obstruction to block certain fluids as well as other potential plugging materials from entering and clogging the annular space 21. The sleeve 50 degrades or dissolves in the presence of well fluids, acids, or other accelerants, opening the annular space 21 to flow in the separator assembly 10.

The sleeves 50 may be constructed of a polymer-based material called Decathane. This material is made into sleeve form and placed between the inner diameter of the outer casing member 22 and the outer diameter of the inner casing member 20 in the separator assembly 10. The open annulus 21 is formed between the two strings, yet with one or more sleeves in place between the two, pressure on either side of the sleeve 50 is essentially isobaric.

The sleeve 50 is used to straddle the lowermost ports 38, which would be considered the intake of the gas separator 10. The straddling and blocking of the annulus 21 above these bottom intake ports 38 prevents fluids, cement, or other foreign matter to flow freely in and through the annular space 21 until the dissolvable material has disappeared over time and the annular space is free and able to communicate with the remainder of the inner casing 20 inner diameter. Use of sleeves 50 between top ports 36 keeps the cement wiper from stalling during transit through the inner casing member 20. A sleeve at the base of the upper slots prevents cement and debris from packing the annular space 21 below their placement. As shown in FIG. 2, one or more sleeves 50 is used at each of these locations.

Once the barrier 24 is installed and the degradable sleeve 50 dissolved, the downhole pump inlet 13 can be located within the artificial sump area 42. The pump may take various forms including an electrical submersible pump, a progressive cavity pump, a reciprocating rod pump, a hydraulic reciprocating pump, or a jet pump for example.

Without the ability to stop free flow of materials into the annular space 21, materials like cement would invade the annulus 21 during pump down. As the cement wiper plug passes by the gas separator assembly 10 it could pack the annular space 21 with cement that would set up solid and permanently block the desired open annular space 21, rendering the gas separator 10 non-functional.

The sleeve 50 as formed and described herein eliminates failure modes and additional processes and costs associated with mechanical or hydraulic movement of a movable sleeve. Further, the sleeve 50 eliminates the need for a downhole actuator that would require a mechanical or hydraulic actuation such as a latch assembly or a ball and seat.

In one embodiment, the sleeve 50 is a slotted sleeve 51. The slotted sleeve 51 is an annular ring filling of all of the annular space 21 except for the longitudinal slot 52. The longitudinal slot 52 allows for a small amount of fluid to pass through the annular space 21 even when the sleeve 50 is intact. The slot 52 will provide additional surface area during degradation of the sleeve 50 with fluid.

Further, gas, whether production gas or air, may exist below the sleeve 50 and barrier 24 within the well. If enough gas builds up, it may form a bubble below the sleeve 50. Such a bubble would prevent fluids from reaching the sleeve 50 and seriously retarding the intended degradation of the sleeve. The slot 52 provides a path for the escape of gas such that well liquids contact the sleeve, enabling its degradation. It may be advantageous to use slotted sleeves 51 where gas accumulation is likely, while not using such slots with other sleeves.

An epoxy layer 54 may be provided on an upper or lower surface of the degradable sleeve. The epoxy layer 54 retards the degradation of the sleeve 50 on the top of the sleeve, causing the degradation to progress from the exposed surfaces of the sleeve 50, including slot 52, that have no epoxy layer.

In use, the inner 20 and outer casing members 22 are installed when completing the outer casing of the well. The sleeve 50 is in place, preventing cement from intruding in the annular space 21. Once a casing is completed, other elements of the separator 10, such as the barrier 24 and the pump 13 may be moved into place.

Upon installation, drilling fluids are preferred to enter the annular space 21 between the outer casing member 22 and the inner casing member 20 once submerged in the ground and when the well is full of drilling fluids. Prior to submergence, the annular space 21 would likely be filled with air. To accelerate and ensure reliability of this process and to allow any trapped gas to escape, the upper sleeve 50 may be cut such that an axial slit 52 would be made to serve as a vent for the gas to escape and for wellbore fluids to enter the space as well.

This will allow the degradable material to dissolve at a known rate both from top and from bottom as to achieve desired and controlled dissolve time. This is not always a desired process to deploy, namely if a much longer dissolve time is desired. Materials and processes may be used to achieve the desired degradation speed of the sleeves 50.

Once all sleeves are dissolved such that a continuous path exists within the annular space 21, fluids and gas may then pass across the sleeves 50. The sleeves will preferably completely dissolve in time, creating an open annular flow-path. With reference again to FIG. 1, the downhole pump intake 13 is located within the artificial sump area 42. The inlet to the pump 13 is preferably located typically at the bottom of the sump area 42 and spaced directly above or in close proximity to the barrier 24. The inlet is spaced well below the first ports 36.

The suction of material in the pump inlet 13 causes gas and liquid flowing up from the casing 12 below the separator 10 to be directed through the bottom ports 38 into the annular space 21. The flow of liquid and gas together continue to flow up the annular space 21. Gas and liquid then returns through the first ports 36 into the inner casing member 20. The denser liquid tends to be drawn downwardly into the artificial sump area 42. Meanwhile, separated gas is directed primarily upwardly from the first ports 36. The gas is preferably primarily within the well casing 12 and not the production tubing 11. Arrows in FIG. 1 show the movement of material through the separator 10.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. An assembly, comprising:

a production tube string positioned within a wellbore;

a hollow inner member having opposed first and second ends and a hollow region extending end-to-end, the first and second ends both configured for connection to a well casing and the inner member defining a longitudinally spaced first port and second port;

an outer member supported outside the inner member to define an annular passage extending longitudinally and externally of the hollow region between a first end and a second end of the outer member and communicating with the hollow region through the first port and the second port;

a barrier positioned within the hollow region between the first port and the second port;

a degradable sleeve disposed in the annular space between the first port and the second port; and a pump inlet within the hollow region between the first port and the barrier.

2. The assembly of claim 1 in which the degradable sleeve defines a longitudinal slit formed therethrough.

3. The assembly of claim 1 in which an interior diameter of the inner member is equal to an interior diameter of the well casing.

4. The assembly of claim 1 in which the outer member surrounds the inner member and has an outer cross-sectional profile that is larger than an outer cross-sectional profile of the well casing.

5. The assembly of claim 1 in which the barrier is removable from the hollow region.

6. The assembly of claim 1 comprising a downhole pump operatively connected to the pump inlet.

7. The assembly of claim 1 in which the degradable sleeve is comprised of a dissolvable metal.

8. The assembly of claim 1 in which the degradable sleeve comprises a first end and a second end, in which an epoxy layer is formed on the first end.

9. The assembly of claim 1 in which the degradable sleeve degrades in the presence of well fluids.

10. The assembly of claim 1 in which the degradable sleeve degrades in the presence of an acid.

11. The assembly of claim 1 in which the degradable sleeve is comprised of a polymer.

12. A method comprising:

connecting first and second ends of an inner member in series with a well casing, the inner member defining a hollow region extending end-to-end of the inner member;

positioning a hollow outer member around the inner member to define an annular space extending longitudinally and positioned between the outer member and the inner member;

positioning a degradable sleeve within the annular space;

positioning a barrier in the inner member between a first port between the hollow region and annular space and a second port between the hollow region and annular space such that produced fluid below the barrier enters the annular space through the second port; and degrading the sleeve such that produced fluid travels through the annular space to the first port.

13. The method of claim 12 further comprising:

positioning a pump inlet within the hollow region between the first port and the barrier;

causing the produced fluid to flow through the first port such that a first portion of the produced fluid is directed towards the pump inlet and a second portion of the produced fluid is directed into the well casing; and pumping the first portion up a production tube through the pump inlet.

14. The method of claim 13 in which the first portion contains less gas than the second portion.

15. The method of claim 12 in which the degradable sleeve defines a longitudinal slot.

16. The method of claim 15 further comprising allowing gas and fluid to pass through the longitudinal slot prior to degradation of the degradable sleeve.

17. The method of claim 16 in which the hollow region between the first port and the second port is sealed to define a sump area above the second port and below the first port.

18. The method of claim 13 further comprising the step of passing a cement wiper plug through the inner member after positioning the outer member and the degradable sleeve and before positioning the barrier.

19. A kit, comprising:

an elongate inner member having opposed first and second ends for connecting the inner member to a well casing in series; wherein the well casing and inner member define a first fluid passage;

an elongate hollow outer member sized to fit around the inner member and having a cross-sectional profile that is larger than that of the well casing, wherein a second fluid passage is formed in an annular space between the outer member and inner member;

a degradable sleeve disposed within the second fluid passage;

a first port formed in the first end of the inner member;

a second port formed in the second end of the inner member;

a barrier positioned in the first fluid passage between the first port and the second port;

a pump inlet positioned in the first fluid passage between the first port and the barrier; and a production tube, defining a third fluid passage, disposed within the inner member and operatively connected to the pump inlet.

20. The kit of claim 19, in which the degradable sleeve comprises at least one epoxy layer for slowing degradation of the sleeve.

21. The kit of claim 19 in which the degradable sleeve defines a longitudinal slot.

22. The kit of claim 19, in which the barrier is removable from the first fluid passage.

23. The kit of claim 19 in which the degradable sleeve is characterized as a first degradable sleeve, further comprising a second degradable sleeve disposed within the second fluid passage.

24. The kit of claim 23 in which the first degradable sleeve is disposed proximate the first port and the second degradable sleeve is disposed proximate the second port.

* * * * *